US010137454B2

(12) United States Patent
Heikkilä et al.

(10) Patent No.: US 10,137,454 B2
(45) Date of Patent: Nov. 27, 2018

(54) MAINTENANCE PLATFORM OF JAW CRUSHER

(71) Applicant: Metso Minerals, Inc., Helsinki (FI)

(72) Inventors: Juhamatti Heikkilä, Tampere (FI); Antti J. Harju, Tampere (FI); Tuomas Tuokko, Tampere (FI); Joni Tattari, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 167 days.

(21) Appl. No.: 14/747,285

(22) Filed: Jun. 23, 2015

(65) Prior Publication Data

US 2016/0375443 A1 Dec. 29, 2016

(51) Int. Cl.
*B02C 1/02* (2006.01)

(52) U.S. Cl.
CPC ..... *B02C 1/02* (2013.01)

(58) Field of Classification Search
CPC .. B02C 1/02; B02C 1/04; B02C 23/04; B30B 9/32
See application file for complete search history.

(56) References Cited

U.S. PATENT DOCUMENTS 570,027 A * 10/1896 Kohler ..... B30B 9/32 100/232
2,794,386 A * 6/1957 Beecher ..... B30B 9/32 100/218
2,866,605 A * 12/1958 Picone ..... B02C 1/02 100/902
3,096,118 A * 7/1963 Dubeck ..... A47C 1/0345 297/75
3,593,986 A * 7/1971 Lee ..... A61G 13/10 5/613
3,628,628 A * 12/1971 Gilbreath ..... E04G 1/152 182/222
4,205,604 A * 6/1980 Ashley ..... B30B 9/326 100/215
4,266,702 A * 5/1981 Jackson ..... B62J 9/00 224/417
4,432,278 A * 2/1984 Skipworth ..... B30B 3/045 100/131

(Continued)

OTHER PUBLICATIONS http://arlweb.msha.gov/Accident_Prevention/ideas/jawcrusher.asp.*

*Primary Examiner* — Katherine W Mitchell
*Assistant Examiner* — Candace L Bradford
(74) *Attorney, Agent, or Firm* — Andrus Intellectual Property Law, LLP

(57) ABSTRACT

A maintenance platform of a jaw crusher having an adapter part that engages a first wear part when in place in a jaw crusher cavity. The platform includes a support part that engages a second wear part when the maintenance platform is in the jaw crusher cavity. The platform further includes a platform part residing between the adapter part and the support part. The platform part has a face section that engages the adapter part and a central section that extends apart from the face section towards the support part. The platform part defines at least two grooves each extending from the central section to the face section. The adapter part joins to the platform part by hand screws or nuts through the grooves. The grooves are shaped such that the platform part is separable from the adapter part after untightening while maintaining in place the hand screws or nuts.

19 Claims, 2 Drawing Sheets

(56) References Cited

U.S. PATENT DOCUMENTS 4,479,753 A * 10/1984 Thorley ..... A61G 3/06 187/243
4,561,165 A * 12/1985 Bayer ..... E04G 1/152 182/119
4,984,654 A * 1/1991 Anderson ..... E04G 1/152 182/186.7
5,110,058 A * 5/1992 Rawson ..... B02C 1/005 241/264
5,257,743 A * 11/1993 Brown, Jr. ..... B02C 19/0031 241/248
5,467,704 A * 11/1995 Mencarelli ..... B30B 9/30 100/131
5,716,014 A * 2/1998 Tamura ..... B02C 18/142 241/101.74
5,857,630 A * 1/1999 Hamaguchi ..... B02C 1/025 241/259.1
8,905,292 B1 * 12/2014 Hayman ..... E04G 7/307 228/178
D733,766 S * 7/2015 Sjoback ..... D15/28
2004/0163890 A1 * 8/2004 Nash, Jr. ..... E06C 7/16 182/122
2007/0273112 A1 * 11/2007 Brink ..... A47C 4/18 280/32.5
2010/0080678 A1 * 4/2010 Beck ..... A61G 3/062 414/539
2010/0193618 A1 * 8/2010 Lewis-Gray ..... B02C 21/02 241/77
2011/0001336 A1 * 1/2011 Miller ..... B60N 2/16 296/193.01
2012/0175448 A1 * 7/2012 Sutti ..... B02C 1/04 241/198.1
2014/0042253 A1 * 2/2014 Miller ..... B02C 1/06 241/27
2015/0217670 A1 * 8/2015 Ablabutyan ..... B60P 1/445 414/546

* cited by examiner

MAINTENANCE PLATFORM OF JAW CRUSHER

TECHNICAL FIELD

The present disclosure generally relates to a maintenance platform of a jaw crusher. The present disclosure relates in particular, though not exclusively, to a modular maintenance platform of a jaw crusher.

BACKGROUND

This section illustrates useful background information without admission of any technique described herein representative of the state of the art.

Jaw crushers are designed to crush mineral material such as rock between two wear parts or jaw dies that form an upwards opening crusher cavity. In operation, typically one of the wear pans is reciprocated closer to and farther apart from the other wear part. The maintenance of the wear parts requires occasional entry by an operating person into the crusher cavity.

At present, the operators have constructed a temporary maintenance platform into the crusher cavity using any materials available. However, such temporary structures are often inadequately designed and implemented, their setup and removal can be time consuming and they may have limited sturdiness and practicality in use.

It is an object of the present disclosure to provide a maintenance platform that overcomes or mitigates problems related to the prior art or at least provides a new technical alternative.

SUMMARY

According to a first aspect of the disclosure there is provided a maintenance platform of a jaw crusher the includes an adapter part configured to engage against a first wear part, when the maintenance platform is in place in a jaw crusher cavity. The platform further includes a support part configured to engage against a second wear part, when the maintenance platform is in place in the jaw crusher cavity. The platform further includes a platform part for standing thereon, the platform part residing between the adapter part and the support part. The platform part further includes a face section configured to engage with the adapter part and a central section configured to extend apart from the face section towards the support part. The platform part defines at least two grooves each extending from the central section to the face section. The adapter part is joinable to the platform part by hand screws or by hand nuts through the grooves and the grooves are shaped such that the platform part is separable from the adapter part after untightening while maintaining in place the hand screws or nuts.

The grooves are shaped such that the platform part is separable from the adapter part after untightening while maintaining in Place the hand screws or nuts may enable a user to detach the adapter part from the platform part simply and quickly without removing and separately storing nuts or screws and without subsequent risk of misaligning the nuts or screws and potentially damaging thread thereon.

The grooves are shaped such that the platform part is separable from the adapter part after untightening. Maintaining in place the hand screws or nuts may enable a user to adapt the length of the maintenance platform based on the distance of the wear parts at desired platform position by changing the adapter part to one of desired length from a selection of adapter parts of different lengths.

The adapter part may comprise a block of elastic material. The block of elastic material may provide good grip and robust settling despite slightly uneven wearing in the wear parts.

The platform part may comprise side sections configured to provide vertical support for handrails. The maintenance platform may comprise the handrails attached to the side sections. The handrails may comprise vertical sections and horizontal top sections on top. The horizontal top sections may be at an outwards extending angle so that the width of the maintenance platform is greater at the top sections than at the platform part.

The increasing of the width of the maintenance platform on top may help to reduce the risk of sideways toppling of the maintenance platform particularly on insertion or removal of the maintenance platform to and or from the crusher cavity.

The platform part may comprise a face section configured to engage with the adapter part or with the first wear part of the crusher. The face section may be coated with or formed of elastic material.

The maintenance platform may further comprise an extension part that is slideably attachable to the platform part as an extension thereof. The extension part may be connected to the support part.

The maintenance platform may be usable without the extension part in smaller jaw crushers, at lower platform position or in connection with new wear parts and in greater jaw crushers, at higher platform position or with the extension part at higher platform position or in connection with used (thin) wear parts.

The support part may comprise a guide plate or two or more guide plates, which may be attachable to edges of the platform part, such as the outmost second edges of the platform part. The guide plates may be separate.

The use of two separate guide plates may enable using same support parts with different platform and extension parts of differing second widths.

The first guide plate and the second guide plate may be attachable to the edge of the support part at user adjustable or user selectable mutual distance. The maintenance platform may comprise means for adjusting by the user the distance between the first and second guide plates.

The guide plates may he angled to conform to the angle of the second wear part.

That the guide plates are angled may improve stability of the maintenance platform when used in the crusher cavity.

A bottom section of the guide plates may be angled by 2 to 20 degrees apart from the angle of the second wear part.

The angled bottom section may facilitate setting up the maintenance platform into the crusher cavity.

The block of elastic material may be attached to a metal plate. The metal plate may comprise bolts or define threaded holes for receiving hand screws aligned with the grooves when the adapter part and the platform part are assembled.

The platform part may be made of profiled metal sheet or composite material. The metal may be aluminum or aluminum alloy.

The support part may he made of profiled metal sheet or composite material. The metal may be aluminum or aluminum alloy. The support part may be coated or covered by an elastic layer on a second surface that engages with a wear part when the maintenance platform is used in the crusher cavity.

Such surfaces of the maintenance platform that engage with a wear part when the maintenance platform is used in the crusher cavity may be covered with elastic material or made of elastic material.

The maintenance platform may weigh less than 50 kg. The maintenance platform may weigh less than 30 kg.

According to a second aspect of the disclosure, there is provided a system of the maintenance platform and a selection of at least two adapter parts or platform parts.

The system may enable easy customization of the system to fit into a variety of different jaw crushers.

The system may further comprise at least one extension part.

Different non-binding example aspects and embodiments of the present invention have been illustrated in the foregoing. The embodiments in the foregoing are used merely to explain selected features or steps that may be utilized in different implementations.

BRIEF DESCRIPTION OF THE DRAWINGS

Some example embodiments of the disclosure will be described with reference to the accompanying drawings, in which.

DETAILED DESCRIPTION

In the following description, like reference signs denote like elements.

Figure 1:
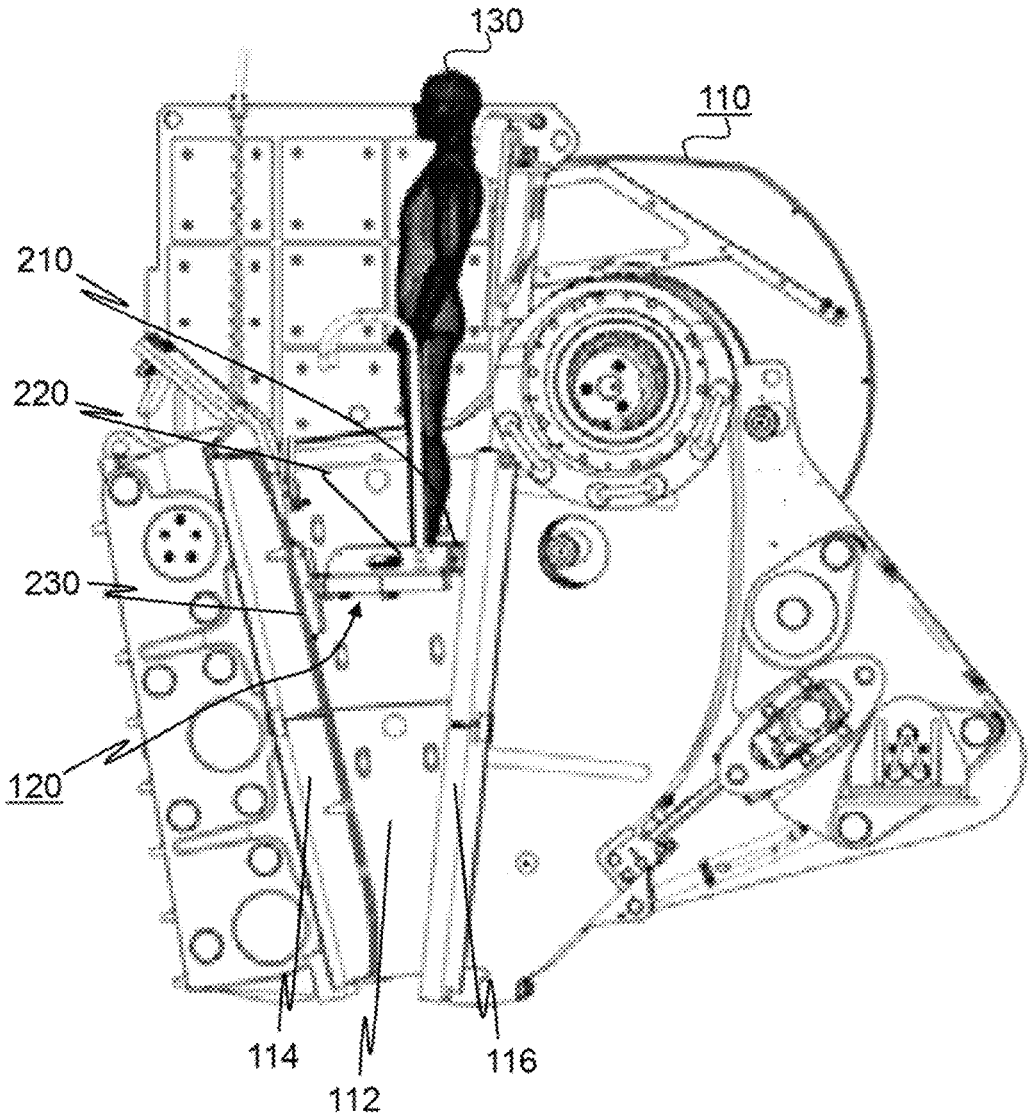
FIG. 1 shows a schematic sectional drawing of a system of an embodiment.

FIG. 1 shows a schematic sectional drawing of a system 100 comprising a jaw crusher 110 and a maintenance platform 120 mounted in a crusher cavity 112 of the jaw crusher 110, according to an embodiment The maintenance platform 120 comprises an adapter part 210 configured to engage against a first wear part 114 (in FIG. 1 behind a user 130), when the maintenance platform 120 is in place in the jaw crusher cavity 112.

Figure 2:
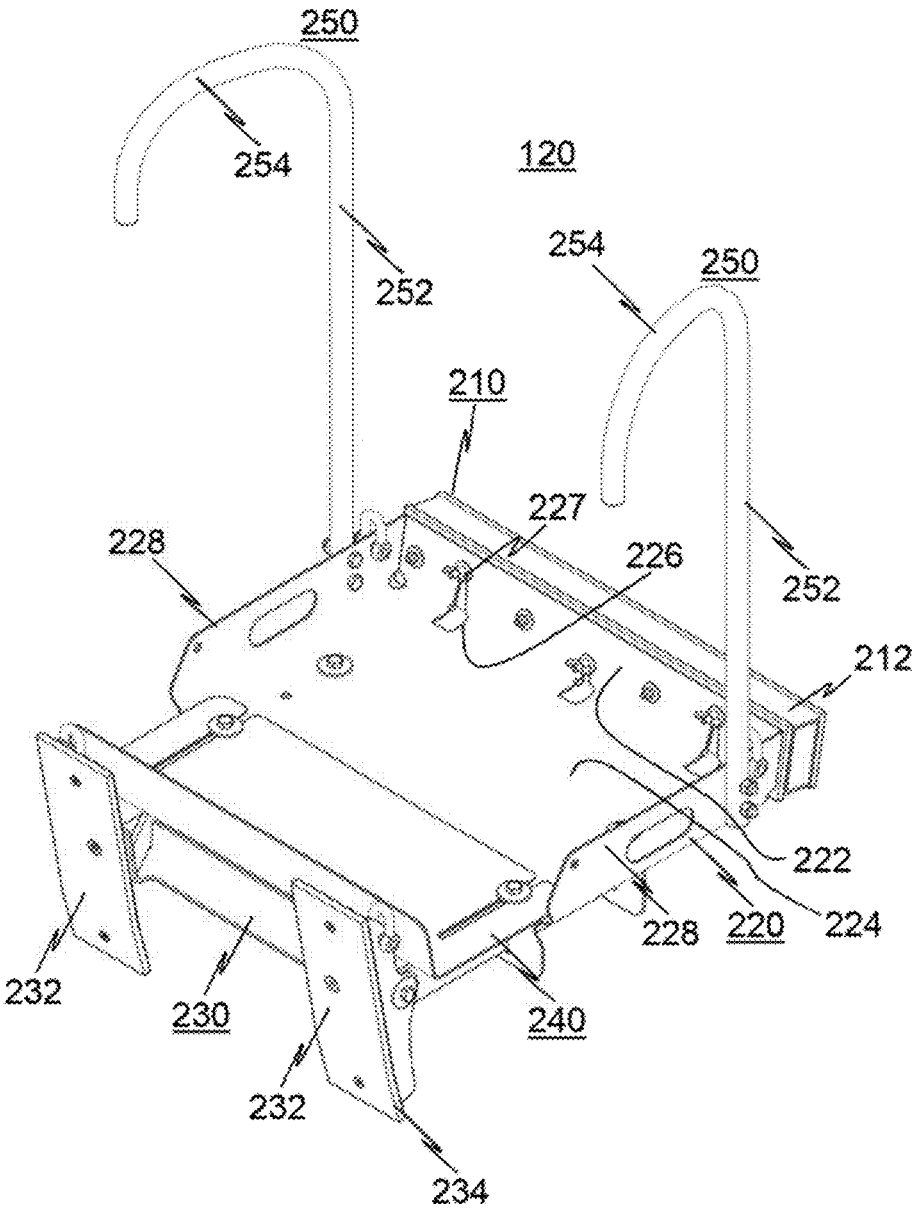
FIG. 2 shows a maintenance platform suited for use in the system of FIG. 1.

FIG. 2 shows the maintenance platform 120 in more detail. The maintenance platform 120 further comprises a support part 230 configured to engage against the second wear part 116 (in front the user 130 in FIG. 1), when the maintenance platform 120 is in place in the jaw crusher cavity 112.

The maintenance platform 120 further comprises a platform part 220 for standing thereon by the user 130. The platform part 220 resides between the adapter part 210 and the support part 230. The platform part 220 comprises a face section 222 configured to engage with the adapter pact 210 and a central section 224 configured to extend apart from the face section 222 towards the support part 230.

The platform part 220 defines at least two grooves 226 each extending from the central section 224 to the face section 222. The adapter part 210 is joinable to the platform part 220 by hand screws or by hand nuts 227 through said grooves 220. The grooves 226 are shaped such that the platform part 220 is separable from the adapter part 210 after untightening while maintaining in place the hand screws or the hand nuts 227.

The hand nuts 227 are preferably used in conjunction with screws fixedly mounted to the adapter part so that even if the locking of such screw joint were entirely removed (hand nuts 227 completely removed), the maintenance platform could remain assembled thanks to the screws locking abutting against ends of the grooves 226, even though work safety could not be ensured without proper locking of the screw joint.

By shaping the grooves 226 such that the platform part 220 is separable from the adapter part 210 after untightening while maintaining in place the hand screws or hand nuts 227, the user 130 may detach the first 210 part from the platform part 220 simply and quickly without removing and separately storing hand nuts 227 or hand screws and without subsequent risk of misaligning the hand nuts 227 or hand screws. Also the risk of damaging the thread may be reduced. It is also possible to use with the hand nuts 227 such screws that are configured to prevent or inhibit removal of the hand nuts. For example. ends of the screws may be flattened or the threading damaged to reduce the risk of accidentally loss of the hand nuts 227.

The grooves 226 being shaped such that the platform part 220 is separable from the adapter part 210 after untightening while maintaining in place the hand screws or hand nuts 227 may enable the user 130 to adapt the length of the maintenance platform based 120 on the distance of the wear parts 114, 116 at desired platform position by changing the adapter part 210 to one of desired length from a selection of adapter parts of different lengths.

The adapter part 210 comprises a block 212 of elastic material. The block 212 of elastic material is configured to provide good grip and robust settling despite slightly uneven wearing in the wear parts. The block 212 of elastic material can be attached to a metal plate that comprises bolts or define threaded holes for receiving hand screws aligned with the grooves when the adapter part and the platform part are assembled.

The platform part 220 comprises side sections 228 configured to provide vertical support for handrails 250. When the maintenance platform 220 is assembled, the handrails 250 are attached to the side sections 228. The handrails 250 comprise vertical sections 252 and horizontal top sections 254 on top. The horizontal top sections 254 are at an outwards extending, angle so that the width of the maintenance platform 120 is greater at the top sections 254 than at the platform part 220.

The maintenance platform 120 further comprises an extension part 240 that is slideably attachable to the platform part 220 as a lateral extension.

The support part 230 comprises two separate guide plates 232. The guide plates are attachable to the outmost second edges of the platform part 220. The guide plates 232 are attachable to the outmost second edges of the extension part 240.

The guide plates 232 are angled to conform to the angle of the second wear part. A bottom section 234 of the guide plates is angled by 2 to 20 degrees apart from the angle of the second wear part 116 (when the maintenance platform 120 is in place in the crusher cavity 112).

The guide plates 232 can be attachable to the edge of the support part at user adjustable Or user selectable mutual distance. For example, correspondingly aligned groove and hand nut connection can be implemented to enable user adjustable mutual distance between the guide plates. Alternatively, the distance may he selectable from two or more alternatives by aligning as guide plate to match with a hole formed in the support part so as to enable a screw connection through the hole, wherein there are two or more boles at different alignment.

The platform part 220 can be made of profiled metal sheet, for example. The metal sheet may be made of steel, aluminum or aluminum alloy, for example.

The support part 230 can made of profiled metal sheet. The metal may be of steel, aluminum or aluminum alloy. The support part may be coated or covered by an elastic layer on a second surface that engages with a wear part when the maintenance platform is used in the crusher cavity.

The maintenance platform may weigh less than 50 kg. The maintenance platform may weigh less than 30 kg.

A maintenance platform system may comprise the maintenance platform 120 and a selection of two or More adapter parts 210 or so that a maintenance platform of desired length can be easily adapted for intended use. The maintenance platform system may further comprise one or more extension parts 240.

Some of the features of the afore-disclosed embodiments of this disclosure may be used to advantage without the corresponding use of other features. Open-ended expressions such as comprise are non-exhaustive: for example, a support part comprising two guide plates may have three or more guide plates as well as two. The foregoing description shall be considered as merely illustrative of the principles of the present disclosure, and not in limitation thereof. Hence, the scope of the disclosure is only restricted by the appended patent claims.

The invention claimed is:

1. A maintenance platform of a jaw crusher, comprising:

an adapter part configured to engage against a first wear part of the jaw crusher when the maintenance platform is in place in a jaw crusher cavity;

a support part configured to engage against a second wear part of the jaw crusher when the maintenance platform is in place in the jaw crusher cavity; and a platform part for standing thereon, the platform part positioned between the adapter part and the support part, the platform part comprising a face section and a central section that is perpendicular to the face section, wherein the face section and the central section together define at least two grooves extending therebetween;

at least two hand-tightenable couplers configured to engage with the adapter part, wherein the at least two grooves are shaped such that the platform part is separable from the adapter part while the at least two hand-tightenable couplers are engaged with the adapter part, and wherein the adapter part is rigidly joinable to the platform part by positioning the at least two hand-tightenable couplers within the at least two grooves and tightening the at least to hand-tightenable couplers; and an extension part that is coupled to the support part, wherein the extension part is slideably attachable to the platform part to adjust a distance between the adapter part and the support part, wherein the maintenance platform is usable without the extension part in smaller jaw crushers or at lower platform position and is usable with the extension part in greater jaw crushers or at higher platform position.

2. The maintenance platform of claim 1, wherein the adapter part has at least two threaded rods extending therefrom, and wherein the at least two hand-tightenable couplers are hand nuts that engage with the adapter part via the at least two threaded rods.

3. The maintenance platform of claim 1, wherein the platform part comprises side sections configured to provide vertical support for attaching handrails to the platform part.

4. The maintenance platform of claim 3, wherein the handrails comprise vertical sections and horizontal top sections on top of the handrails.

5. The maintenance platform of claim 4, wherein the horizontal top sections are at an outwards extending angle such that the width of the maintenance platform is greater at the top sections than at the platform part.

6. The maintenance platform of claim 1, wherein the adapter part includes a block of elastic material configured to engage with the first wear part of the jaw crusher.

7. The maintenance platform of claim 6, wherein the block of elastic material is attached to a metal plate that is configured to engage with the at least two hand-tightenable couplers when the adapter part and the platform part are rigidly joined.

8. The maintenance platform of claim 1, one or more of the platform part and the support part being made from a group consisting of profiled metal sheet, aluminum or aluminum alloy, or composite material.

9. The maintenance platform of claim 8 wherein such surfaces of the maintenance platform that engage with a wear part when the maintenance platform is used in the crusher cavity are covered with elastic material or made of elastic material.

10. The maintenance platform of claim 1, wherein the maintenance platform is configured to weigh less than 50 kg.

11. A system, comprising:

the maintenance platform of claim 1; and a selection of at least two adapter parts or platform parts.

12. The system of claim 11, wherein the extension part comprises at least two extension parts each configured to extend the platform.

13. A maintenance platform of a jaw crusher, comprising:

an adapter part configured to engage against a first wear part of the jaw crusher when the maintenance platform is in place in a jaw crusher cavity;

a support part configured to engage against a second wear part of the jaw crusher when the maintenance platform is in place in the jaw crusher cavity wherein the support part includes a guide plate that extends at an angle relative to the support part; and a platform part for standing thereon, the platform part positioned between the adapter part and the support part, the platform part comprising a face section and a central section that is perpendicular to the face section, wherein the face section and the central section together define at least two grooves extending therebetween;

at least two hand-tightenable couplers configured to engage with the adapter part, wherein the at least two grooves are shaped such that the platform part is separable from the adapter part while the at least two hand-tightenable couplers are engaged with the adapter part, and wherein the adapter part is rigidly joinable to the platform part by positioning the at least two hand-tightenable couplers within the at least two grooves and tightening the at least to hand-tightenable couplers; and an extension part that is coupled to the support part, wherein the extension part is slideably attachable to the platform part to adjust a distance between the adapter part and the support part.

14. The maintenance platform of claim 13, wherein the guide plate is attached to an edge of the support part.

15. The maintenance platform of claim 14, wherein the support part includes a second guide plate attached to the edge of the support part.

16. The maintenance platform of claim 15, wherein the first guide plate and the second guide plate are attached to the edge of the support part at user adjustable or user selectable mutual distance.

17. The maintenance platform of claim 16, wherein:

the guide plates are attachable to second edges of the extension part.

18. The maintenance platform of claim 17, wherein the guide plates are angled to conform to the angle of the second wear part.

19. The maintenance platform of claim 18, wherein the guide plates have a bottom section at which the guide plates are angled by 2 to 20 degrees apart from the angle of the second wear part, when the maintenance platform is in place in the crusher cavity.

* * * * *